US009624700B2

(12) United States Patent
Wollacott et al.

(10) Patent No.: US 9,624,700 B2
(45) Date of Patent: Apr. 18, 2017

(54) PADDLE LATCH

(71) Applicant: Weston Body Hardware Limited, Redditch, Worcestershire (GB)

(72) Inventors: Martin Wollacott, Worcestershire (GB); John Frederick Bray, Worcestershire (GB); Harjit Singh Sagoo, Worcestershire (GB); Anthony Jeremy Stanton, Worcestershire (GB)

(73) Assignee: Weston Body Hardware Limited, Worcestershire (GB)

( * ) Notice: Subject to any disclaimer, the term of this patent is extended or adjusted under 35 U.S.C. 154(b) by 0 days.

(21) Appl. No.: 14/944,384

(22) Filed: Nov. 18, 2015

(65) Prior Publication Data

US 2016/0138309 A1 May 19, 2016

(30) Foreign Application Priority Data

Nov. 19, 2014 (GB) ..... GB1420576.9

(51) Int. Cl.

| | |
|---|---|
| ***E05B 17/00*** | (2006.01) |
| ***E05C 1/14*** | (2006.01) |
| ***E05B 63/06*** | (2006.01) |
| *E05B 17/20* | (2006.01) |
| *E05B 67/38* | (2006.01) |
| *E05B 13/00* | (2006.01) |

(52) U.S. Cl.

CPC ..... *E05C 1/145* (2013.01); *E05B 63/06* (2013.01); *E05B 13/002* (2013.01); *E05B 17/2034* (2013.01); *E05B 67/383* (2013.01)

(58) Field of Classification Search

CPC ..... Y10S 292/31; Y10S 292/60; E05C 1/085; E05B 15/04; E05B 15/101; E05B 17/0037; E05B 63/20; E05B 63/202

USPC ..... 292/137, 163, 173; 70/208, 210, 212, 70/461

See application file for complete search history.

(56) References Cited

U.S. PATENT DOCUMENTS

| | | | | | |
|---|---|---|---|---|---|
| 671,792 | A * | 4/1901 | Comber | E05B 15/10 | 292/2 |
| 2,496,737 | A * | 2/1950 | McCallick | E05B 5/003 | 292/1 |
| 2,916,905 | A * | 12/1959 | Podlesak | E05C 1/145 | 292/173 |
| 2,987,908 | A * | 6/1961 | Pelcin | E05C 1/145 | 292/173 |
| 3,552,158 | A * | 1/1971 | Van Lengen | E05C 1/166 | 292/153 |
| 3,707,862 | A * | 1/1973 | Pastva, Jr. | E05C 1/145 | 292/173 |
| 3,871,198 | A * | 3/1975 | Miller | E05C 1/145 | 292/173 |

(Continued)

*Primary Examiner* — Janet M Wilkens
(74) *Attorney, Agent, or Firm* — NK Patent Law, PLLC

(57) ABSTRACT

A paddle latch comprising a housing, a latch member and a bolt; wherein the bolt is mounted for sliding axial movement between a first, deployed, position and a second, retracted, position. The latch member is configured to move the bolt between said first and second positions upon actuation by a user. The paddle latch further comprises an adjustment mechanism. The adjustment mechanism is configured to provide selective adjustment of the deployed position of the bolt with respect to the housing.

18 Claims, 5 Drawing Sheets

(56) References Cited

U.S. PATENT DOCUMENTS

| | | | | | |
|---|---|---|---|---|---|
| 4,138,869 | A * | 2/1979 | Pelcin | E05B 55/00 | 292/173 |
| 4,231,597 | A * | 11/1980 | Pelcin | E05C 1/145 | 292/143 |
| 4,312,202 | A * | 1/1982 | Pastva, Jr. | E05C 1/145 | 292/173 |
| 4,312,204 | A * | 1/1982 | Davis | E05C 1/145 | 292/167 |
| 4,312,205 | A * | 1/1982 | Reed | E05C 1/145 | 292/173 |
| 4,321,812 | A * | 3/1982 | Pelcin | E05C 1/145 | 292/173 |
| 4,335,595 | A * | 6/1982 | Swan | E05C 1/145 | 292/173 |
| 4,420,954 | A * | 12/1983 | Hieronymi | E05C 1/145 | 292/173 |
| 4,662,666 | A * | 5/1987 | Wimmer | E05C 1/163 | 292/1.5 |
| 6,547,290 | B1 * | 4/2003 | Zenner | E05B 9/00 | 292/167 |
| 7,607,701 | B2 * | 10/2009 | Levine | E05B 63/06 | 292/1.5 |

* cited by examiner

PADDLE LATCH

CROSS-REFERENCE TO RELATED APPLICATIONS

This application claims priority to Great Britain application no. GB1420576.9 filed on Nov. 19, 2014, the entire contents of which are incorporated by reference.

FIELD OF THE INVENTION

The present invention relates to a paddle latch with an adjustable bolt.

BACKGROUND OF THE INVENTION

It is known to use a paddle latch or other suitable latch to secure a closure. It is known in particular to use a paddle latch to secure a closure for an industrial housing, or a vehicle closure.

The term "paddle latch" is used throughout this specification to indicate a latch of the type having a flat paddle handle arranged to pivot about a shaft or pin to operate a latch member which, when in a latched condition, engages with a feature on a closure frame such that the corresponding closure cannot be opened. The latch member is mounted such that it can be axially slid from a latched position whereby it engages the feature on the closure frame to an unlatched position whereby it is clear of that feature and the closure can be opened.

In known paddle latches, the latch member is often resiliently biased towards the latched position. Unlatching can be achieved by actuating the paddle which physically contacts the latch member, directly or through some intermediate component, overcoming the resilient bias and moving the latch member into an unlatched position whereby the door may be opened.

In such latches it is common for a closure to which a latch is attached to be out of alignment with the closure frame. This can lead to the latch failing to effectively secure the closure, as the latch bolt may be extended too far or not extended enough in relation to the closure frame, so would fail to latch.

It is not unusual for closures to be misaligned with relation to a closure frame when a latch is fitted. It is also known for misalignment to occur during use due to wear, or movement during transportation, or, in the case of a closure on a vehicle, during motion.

It is known to adjust the geometry of the closure frame or the latch in response to misalignment, for example by grinding the latch bolt, or bending or removing parts of the closure frame. However, these solutions are difficult and time consuming. They can lead to damage and may be inaccurate.

There is a need for an improved latch.

SUMMARY OF THE INVENTION

According to an aspect of the invention there is provided a paddle latch comprising a housing, a latch member and a bolt; wherein the bolt is mounted for axial movement between a first, deployed, position and a second, retracted, position; and wherein the latch member is configured to move the bolt between said first and second positions upon actuation by a user; the paddle latch further comprising an adjustment mechanism; wherein the adjustment mechanism is configured to provide selective adjustment of the deployed position of the bolt with respect to the housing.

The deployed position of the bolt can thus be adjusted in response to misalignment of a closure and its frame, to ensure that the closure can be secured.

Access for operation of the adjustment mechanism may be available via an exposed part of the latch.

The housing and main body of a latch is often concealed, for example within the body of a closure. It is therefore advantageous to be able to access the adjustment mechanism without the need to access the housing, as it is easier and quicker to adjust the deployed position of the bolt with respect to the housing.

The bolt may comprise an exposed end, and the adjustment mechanism may be accessible for operation via the exposed end of the bolt.

The bolt is likely to be the most accessible part of a latch, as it is by necessity exposed at an edge of a closure (or in some cases a closure frame). Accessing the adjustment mechanism through the bolt is therefore simple and quick.

The bolt may define a bore configured to provide access to the adjustment mechanism.

The adjustment mechanism may be configured to provide selective adjustment of the deployed position with respect to the latch member.

Adjusting the bolt with respect to the latch member allows the latch member to retain its relationship with the housing, so that components such as a pawl do not need to be adjusted.

The adjustment mechanism may comprise a threaded fastener linking the bolt and the latch member.

A threaded fastener is a simple and effective type of adjustment mechanism. The thread allows continuous adjustment, so any position within a range can be selected.

The threaded fastener may be parallel to a longitudinal axis of the bolt. This provides a simple arrangement of the adjustment mechanism.

The threaded fastener may have a head which may be proximal an exposed end of the bolt. Such an arrangement provides ease of access to the threaded fastener via the bolt.

The threaded fastener may be a socket head screw. An allen key (or "hex key"), a standard and readily available tool, could thus advantageously be used to operate the adjustment mechanism.

Alternatively, the threaded fastener may be a cross-head screw. A cross-head screwdriver, another standard and readily available tool, could thus advantageously be used to operate the adjustment mechanism.

Alternatively, the threaded fastener may be a star head screw. A star-head screwdriver, yet another standard and readily available tool, could thus advantageously be used to operate the adjustment mechanism.

The latch may further comprise a retainer configured to locate the threaded fastener with respect to the bolt. The retainer may be of plastics material.

The threaded fastener is thus held in place by a component that doubles as an anti-rattle device, decreasing the likelihood of loosening of the threaded fastener due to vibration.

The range of adjustment of the deployed position of the bolt with respect to the housing may be between 3 mm and 10 mm. Such a range allows for a suitable range of adjustment, covering a likely range of misalignment between a closure and its frame.

The bolt may be resiliently biased towards the deployed position.

The latch may further comprise a handle and a pawl; wherein the handle may be pivotably supported by the housing; wherein the handle may be configured to rotate the pawl; and wherein the pawl may be configured to move the bolt linearly in an axial direction between said first and second positions upon rotation by the handle.

The latch may further comprise a lock. This provides security for the closure. The lock may be a cylinder lock.

According to a further aspect of the invention, there is provided a latch comprising a housing, a latch member and a bolt; wherein the bolt is mounted for axial movement between a first, deployed, position and a second, retracted, position; and wherein the latch member is configured to move the bolt between said first and second positions upon actuation by a user; the latch further comprising an adjustment mechanism; wherein the adjustment mechanism is configured to provide selective axial adjustment of the deployed position of the bolt with respect to the housing; and wherein access for operation of the adjustment mechanism is available via an exposed part of the latch.

Again, the deployed position of the bolt can thus be adjusted in response to misalignment of a closure and its frame, to ensure that the closure can be secured, and easy access to the adjustment mechanism is provided.

The bolt may comprise an exposed end, and the adjustment mechanism may be accessible for operation via the exposed end of the bolt.

The bolt may define a bore configured to provide access to the adjustment mechanism.

The adjustment mechanism may be configured to provide selective adjustment of the deployed position with respect to the latch member.

Adjusting the bolt with respect to the latch member allows the latch member to retain its relationship with the housing, so that components such as a pawl do not need to be adjusted.

The adjustment mechanism may comprise a threaded fastener linking the bolt and the latch member.

A threaded fastener is a simple and effective type of adjustment mechanism. The thread allows continuous adjustment, so any position within a range can be selected.

The threaded fastener may be parallel to a longitudinal axis of the bolt. This provides a simple arrangement of the adjustment mechanism.

The threaded fastener may have a head which may be proximal an exposed end of the bolt. Such an arrangement provides ease of access to the threaded fastener via the bolt.

The threaded fastener may be a socket head screw. An allen key (or "hex key"), a standard and readily available tool, could thus advantageously be used to operate the adjustment mechanism.

Alternatively, the threaded fastener may be a cross-head screw. A cross-head screwdriver, another standard and readily available tool, could thus advantageously be used to operate the adjustment mechanism.

Alternatively, the threaded fastener may be a star head screw. A star-head screwdriver, yet another standard and readily available tool, could thus advantageously be used to operate the adjustment mechanism.

The latch may further comprise a retainer configured to locate the threaded fastener with respect to the bolt. The retainer may be of plastics material.

The threaded fastener is thus held in place by a component that doubles as an anti-rattle device, decreasing the likelihood of loosening of the threaded fastener due to vibration.

The range of adjustment of the deployed position of the bolt with respect to the housing may be between 3 mm and 10 mm. Such a range allows for a suitable range of adjustment, covering a likely range of misalignment between a closure and its frame.

The bolt may be resiliently biased towards the deployed position.

The latch may further comprise a handle and a pawl; wherein the handle may be pivotably supported by the housing; wherein the handle may be configured to rotate the pawl; and wherein the pawl may be configured to move the bolt linearly in an axial direction between said first and second positions upon rotation by the handle.

The latch may further comprise a lock. This provides security for the closure. The lock may be a cylinder lock.

BRIEF DESCRIPTION OF THE DRAWINGS

There now follows a description of a preferred embodiment(s) of the invention, by way of non-limiting example, with reference being made to the accompanying drawings, in which.

DETAILED DESCRIPTION OF EMBODIMENT(S)

Figure 1:
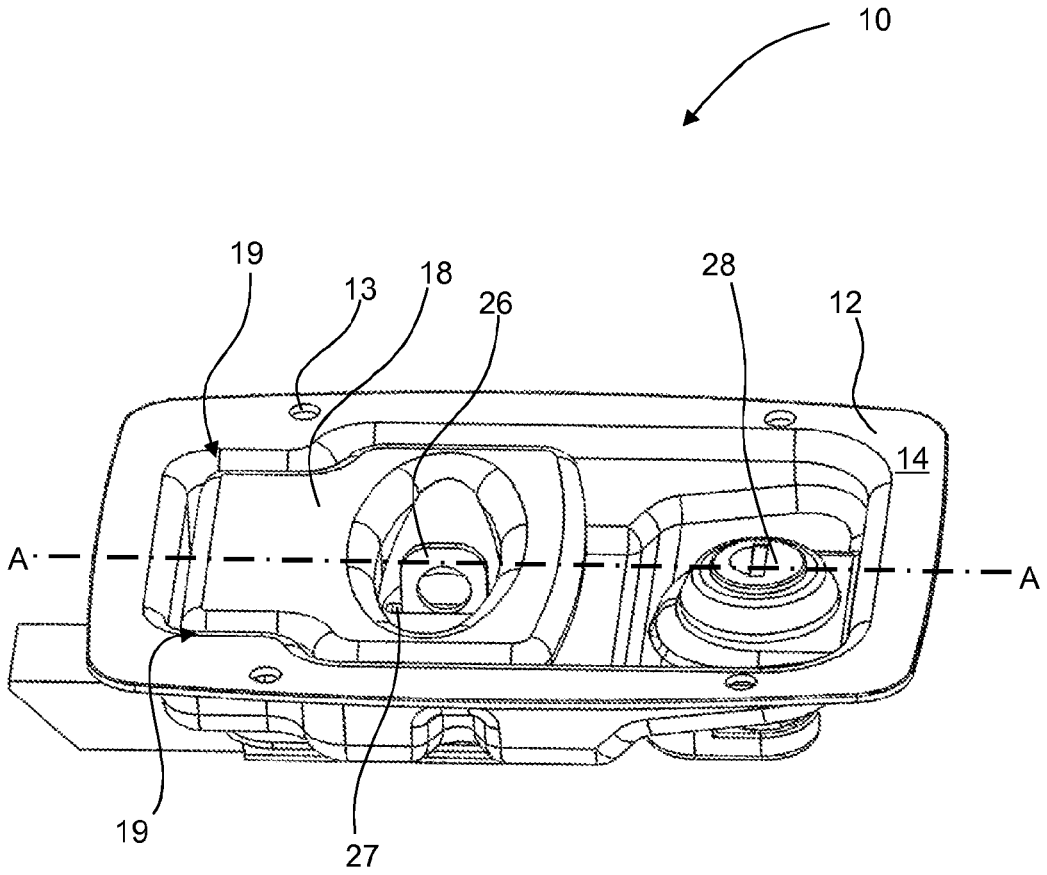
FIG. 1 is a perspective view of a paddle latch according to an embodiment of the invention.
Figure 2:
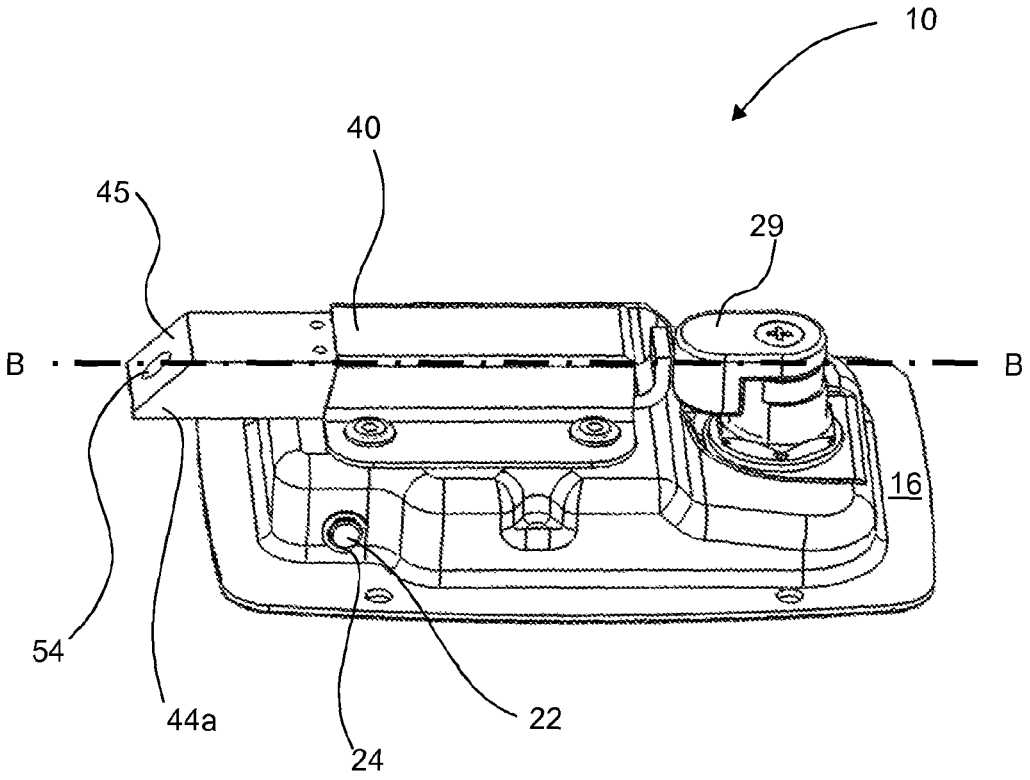
FIG. 2 is a further perspective view of the paddle latch of the embodiment of FIG. 1.
Figure 3:
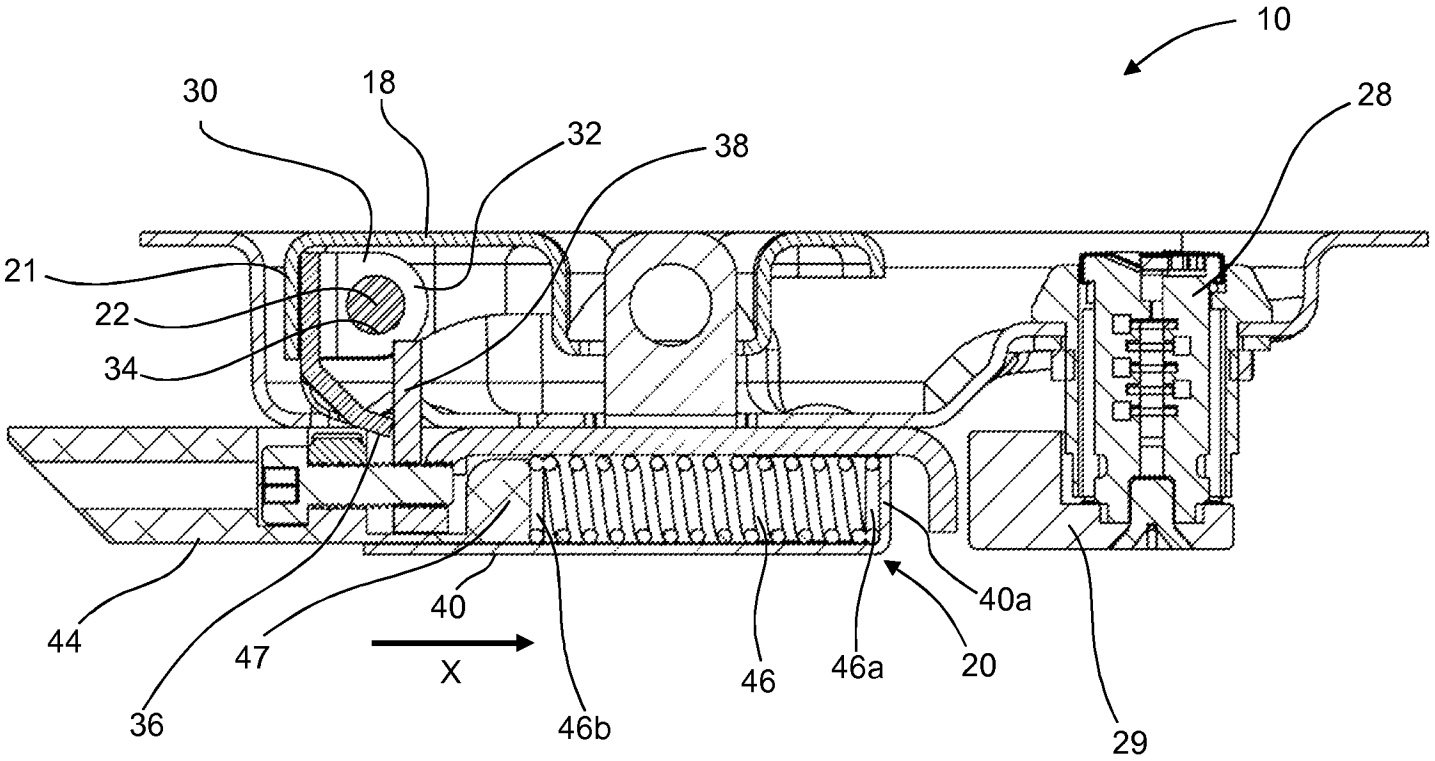
FIG. 3 is a cross-sectional view through the paddle latch of the embodiment of FIGS. 1 and 2 along the axis A-A.
Figure 4:
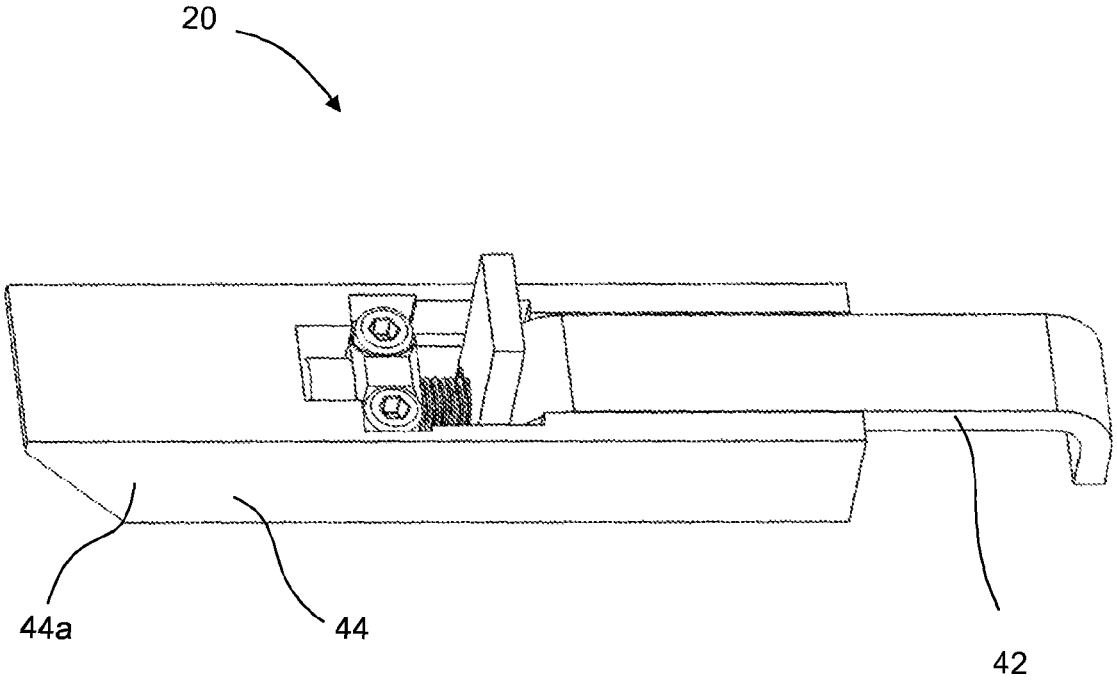
FIG. 4 is a perspective view of a bolt and latch member assembly of the embodiment of FIGS. 2 and 3.

With reference to FIGS. 1 to 3, a paddle latch is generally indicated at 10. The paddle latch 10 is configured for use with a closure (not shown).

The paddle latch 10 comprises a housing 12 which defines an outer side 14 and an inner side 16, where the outer side is configured for exposure on an outer side of a closure. The housing 12 defines a series of apertures 13 about its perimeter. The apertures 13 are configured to receive fasteners (not shown) for attaching the latch 10 to a closure.

The paddle latch 10 comprises a handle 18 configured to operate a latch member assembly 20, as described in further detail below. The handle 18 is movable between a closed position (as shown in FIGS. 1 to 3), where the associated latch member assembly 20 (see FIG. 3) is moved to a deployed position and is configured to engage a closure frame, and an open position, where the associated latch member assembly 20 is moved to a retracted position and is configured to allow opening of a closure. The outer side 14 is configured to be accessible for operation by a user so that the handle 18 can be used to slide the latch 10 axially between the retracted and deployed positions.

The handle 18 is pivotably supported on the outer side 14 of the housing 12 at a pivot point 19. The housing 12 defines two pivot point apertures (not shown) opposite to and aligned with one another at the pivot point 19. The pivot point 19 comprises a pivot pin 22, which extends through the pivot point apertures and through the corresponding apertures (not shown) of the handle 18. The pivot pin 22 extends through the apertures of the handle 18 in a clearance fit. The ends of the pivot pin 22 extend through the housing 12 to the inner side 16. An e-clip 24 is clipped around each end of the pivot pin 22 in a corresponding groove (not shown) in order to locate the pivot pin 22.

The housing 12 of this embodiment defines a loop 26 for a padlock (not shown). The loop 26 extends through a corresponding aperture 27 in the handle 18 when the handle 18 is in the closed position, such that a padlock may be used to secure the handle 18 in the closed position and so prevent operation of the latch 10. The housing 12 also defines an aperture suitable for a cylinder lock 28 configured to prevent the latch member assembly 20 being moved from a deployed to a retracted position. In alternative embodiments, some other suitable type of lock may be used.

The latch 10 comprises a pawl 30 (see FIG. 3) configured to act between the handle 18 and the latch member assembly 20. The pawl 30 comprises two arms 32 extending parallel to one another. Each arm 32 defines an aperture 34 through which the pivot pin 22 extends. The handle 18 has an arm 21 extending over the outer profile of the pawl 30. As the handle 18 is pivoted about the pivot point 19 by a user, the arm 21 causes the pawl 30 to rotate about the pivot point 19. The pawl 30 defines a cam 36 arranged to move the latch member assembly 20 in a linear direction, as indicated by the arrow X in FIG. 3, when the pawl 30 is rotated by operation of the handle 18 as described above.

The latch member assembly 20 is generally located on the inner side 16 of the housing 12. The latch member assembly 20 comprises a latch member 42 and an elongate bolt 44. The latch member assembly 20 is supported on the inner side 16 of the housing 12 by a bracket 40, which is in this embodiment riveted to the housing 12.

The latch member 42 comprises a planar body 42*c* and two parallel arms 42*a*, 42*b* extending parallel to one another perpendicular to the planar body 42*c*. The first arm 42*a* of the latch member 42 extends beyond the bolt and beyond the end 40*a* of the bracket 40, and is proximal the lock 28. The lock 28 has a latch bar 29 that is, upon locking, pivoted to the position shown in FIG. 3, where the bar 29 interferes with movement of the latch member 42 in direction X, thus preventing movement of the latch member assembly 20 from the deployed position. The latch member 42 further comprises an arm 38 extending perpendicular to the planar body in the opposite direction to the two parallel arms 42*a*, 42*b*. The arm 38 extends from the inner side 16 to the outer side 14 of the housing 12 and is configured to be acted upon by the cam 36.

The latch member 42 of this embodiment is of a suitable metal, such as stainless steel. In alternative embodiments, the latch member may be of some other suitable material, such as plastics material.

Figure 5:
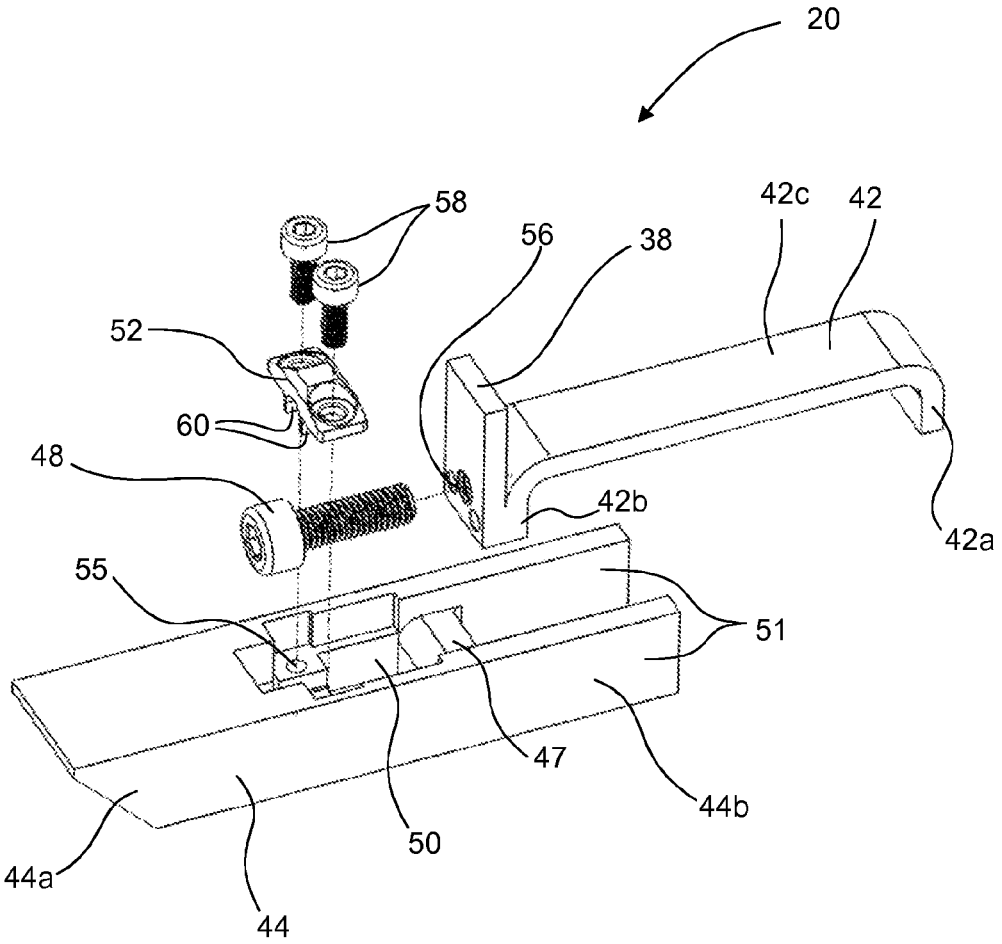
FIG. 5 is an exploded view of the bolt and latch member assembly of FIG. 4.

As can be seen from FIG. 5, the bolt 44 has a first, exposed, end 44*a* and a second end 44*b*. The first end 44*a* is configured to engage a closure frame to secure a closure to which the latch 10 is attached. The first end 44*a* defines in this embodiment a chamfered end surface 45. That is, the end surface 45 is angled with respect to the body of the bolt 44. In alternative embodiments, the end surface may be curved. The second end 44*b* of the bolt 44 has parallel side walls 51 defining a well 50.

The bolt 44 of this embodiment is of a suitable metal, such as stainless steel. In alternative embodiments, the bolt may be of some other suitable material, such as plastics material.

The latch member assembly 20 is resiliently biased towards the deployed position shown in FIGS. 1 to 3. In this embodiment, a spring 46 provides resilient bias. The spring 46 is retained by the bracket 40, and is located at a first end 46*a* by an end 40*a* of the bracket 40. A second end 46*b* of the spring, proximal the bolt 44, abuts a bar 47 extending between the two side walls 51 of the bolt 44. The spring 46 thus biases the bolt 44 towards the deployed position, i.e. in the opposite direction to that indicated by the arrow X in FIG. 3.

The latch member assembly 20 further comprises an adjustment mechanism configured to allow adjustment of the deployed position of the bolt 44 with respect to the remainder of the latch member assembly 20, and thus with respect to the housing 12, as described in further detail below.

The adjustment mechanism of this embodiment comprises a single threaded fastener 48 connecting the bolt 44 and the latch member 42. The well 50 is configured to receive the threaded fastener 48 between the side walls 51. The second arm 42*b* of the latch member 42 is proximal the bolt 44, and defines a threaded aperture 56 configured to receive the threaded fastener 48.

In this embodiment, the threaded fastener is a screw 48. The screw of this embodiment is a cap screw 48, although other suitable screws or threaded fasteners may be used in alternative embodiments. The screw 48 of this embodiment is an M5 screw, though other suitably sized screws may be used. For example, the screw may be in the range of M4 to M8.

The screw 48 is held in place in the bolt 44 by a threaded retainer 52. The retainer 52 defines two apertures (not shown) configured to receive retaining screws 58, which extend into corresponding threaded apertures 55 in the bolt 44. The retainer 52 has two arms 60 (see FIG. 5) which extend in parallel either side of the threaded shaft of the screw 48. The retainer 52 sits below the head of the screw 48, so securing the screw 48 in the axial direction X. The screw 48 is retained axially in the opposite direction by the body of the bolt 44. The retainer 52 is in this embodiment of plastics material, and acts as an anti-rattle device. That is, the retainer 52 inhibits loosening of the screw 48 due to vibration. In alternative embodiments the retainer 52 may be of some other suitable material.

The bolt 44 defines a bore 54 extending substantially co-axially with the longitudinal axis BB of the bolt (see FIG. 2). The bore 54 extends from the end surface 45 of the bolt 44 to the well 50, and provides access to the head of the screw 48. Access for operation of the adjustment mechanism 48 is thus available via an exposed part of the latch 10. An exposed part of the latch 10 is in this case deemed to be one accessible without the need for special tools, and without gaining access to the housing 12, whilst the latch 10 is in use, i.e. attached to a closure.

In this embodiment, the screw is a socket head cap screw 48 with a standard hexagonal socket, and the bore 54 provides suitable access for a standard allen key or hex key for operation of the screw 48. The bore 54 is of a diameter large enough to provide access to the screw 48, yet small enough to allow the bolt 44 to be of the required strength. In this embodiment, for example, where an M5 screw is used, the bore 54 has a diameter of 6 mm, which allows access of a suitable allen key.

In alternative embodiments, the bore and/or the threaded fastener may not be co-axial with or parallel to the longitudinal axis of the bolt. For example, the bore and/or the threaded fastener may be at an angle to the longitudinal axis of the bolt, e.g. at between 1° and 5° to the longitudinal axis of the bolt. The bore and the threaded fastener may not share an axis.

In use, where an operator wishes to adjust the deployed position of the bolt 44 with respect to the closure to which the latch 10 is attached, an allen key (not shown) is inserted into the bore 54 and used to rotate the screw 48. The direction of rotation depends on the required direction of adjustment. In this embodiment, the screw 48 has a standard right-hand thread, so rotating the screw 48 in an anticlockwise direction drives the bolt 44 away from the latch member 42, thus extending the bolt 44 with respect to the housing 12. Rotating the screw in a clockwise direction drives the bolt 44 towards the latch member 42, thus retracting the bolt 44 with respect to the housing 12. The bolt 44 moves with the head of the screw 48, due to the retainer 52. The latch member 42 is retained in place with respect to the housing 12 by the pawl 30.

Adjustment of the deployed position of the bolt 44 thus advantageously takes place in the direction of normal motion of the bolt 44, i.e. along the axis B-B.

In this embodiment, the screw 48 allows approximately 5 mm of adjustment between the bolt 44 and the latch member 42. This provides a suitable range of adjustment for common closure misalignment. In alternative embodiments, a smaller or greater range of adjustment between the bolt and the latch member may be provided. For example, an adjustment range of between 3 mm and 10 mm may be provided, or some other, larger, suitable range may be provided.

The adjustment mechanism provides a simple and effective method of adjusting the deployed position of a bolt, so addressing the problems caused by misalignment of a closure and its frame. Adjustment is easily carried out manually with a standard tool, with no need for any power supply. A large range of adjustment can be provided.

In alternative embodiments, the adjustment mechanism may comprise more than one threaded fastener 48. For example, the adjustment mechanism 48 may comprise two screws in parallel. In alternative embodiments, the adjustment mechanism may comprise some form of ratchet rather than a threaded fastener. In alternative embodiments, the threaded fastener may be adjustable without the need for a tool, for example the head of the threaded fastener may extend beyond the housing for manual operation.

In alternative embodiments, the adjustment mechanism may comprise some other type of threaded fastener. For example, the threaded fastener may be a socket head screw with a socket of some other suitable shape, such as square. Alternatively, a cross-head, cross-slotted, Pozidriv®, slotted screw or star head screw may be used.

Although described in relation to a latch with an axially sliding latch member, the adjustable bolt arrangement could be used with suitable alternative latch types. For example, the adjustable bolt arrangement could be used with a paddle latch having a rotatable hook operated by the latch member. In such an arrangement, the deployed position of the latch member could be adjusted in order to adjust the deployed position of the hook.

What is claimed is:

1. A paddle latch comprising:

a housing;

a latch member; and a bolt;

wherein the bolt is mounted for axial movement between a first, deployed, position and a second, retracted, position; and wherein the latch member is configured to move the bolt between said first and second positions upon actuation by a user;

the paddle latch further comprising an adjustment mechanism directly connecting the bolt and the latch member;

wherein the adjustment mechanism is configured to provide selective axial adjustment of the deployed position of the bolt with respect to the housing.

2. A latch according to claim 1 wherein access for operation of the adjustment mechanism is available via an exposed part of the latch.

3. A latch according to claim 2 wherein the bolt comprises an exposed end, and wherein the adjustment mechanism is accessible for operation via the exposed end of the bolt.

4. A latch according to claim 1 wherein the bolt comprises an exposed end, and wherein the adjustment mechanism is accessible for operation via the exposed end of the bolt.

5. A latch according to claim 4 wherein the bolt defines a bore configured to provide access to the adjustment mechanism.

6. A latch according to claim 1 wherein the adjustment mechanism is configured to provide selective adjustment of the deployed position of the bolt with respect to the latch member.

7. A latch according to claim 1 wherein the adjustment mechanism comprises a threaded fastener linking the bolt and the latch member.

8. A latch according to claim 7 wherein the longitudinal axis of the threaded fastener is parallel to a longitudinal axis of the bolt.

9. A latch according to claim 8 wherein the threaded fastener has a head which is proximal an exposed end of the bolt.

10. A latch according to claim 7 wherein the threaded fastener is a socket head screw.

11. A latch according to claim 7 wherein the threaded fastener is a cross-head screw.

12. A latch according to claim 7 wherein the threaded fastener is a star head screw.

13. A latch according to claim 7 further comprising a retainer configured to locate the threaded fastener with respect to the bolt.

14. A latch according to claim 13 wherein the retainer is of plastics material.

15. A latch according to claim 1 wherein the range of adjustment of the deployed position of the bolt with respect to the housing is between 3 mm and 10 mm.

16. A latch according to claim 1 wherein the bolt is resiliently biased towards the deployed position.

17. A latch according to claim 1 further comprising a handle and a pawl; wherein the handle is pivotably supported by the housing; wherein the handle is configured to rotate the pawl; and wherein the pawl is configured to move the latch member to move the bolt linearly in an axial direction between said first and second positions upon rotation by the handle.

18. A latch according to claim 1 further comprising a lock.

* * * * *